US005926192A

United States Patent [19]

Yamane

[11] Patent Number: 5,926,192

[45] Date of Patent: Jul. 20, 1999

[54] PRINT CONTROL SYSTEM

[75] Inventor: Toshiyuki Yamane, Chiryu, Japan

[73] Assignee: Brother Kogyo Kabushiki Kaisha, Nagoya, Japan

[21] Appl. No.: 08/706,466

[22] Filed: Sep. 4, 1996

[30] Foreign Application Priority Data

Sep. 5, 1995 [JP] Japan ..... 7-254665

[51] Int. Cl.[6] ..... B41J 21/00

[52] U.S. Cl. ..... 347/10; 347/37; 400/279; 400/705.1

[58] Field of Search ..... 400/279, 124.04, 400/705, 705.1; 347/10, 11, 37

[56] References Cited

U.S. PATENT DOCUMENTS 5,306,084 4/1994 Orii ..... 400/124.04
5,439,301 8/1995 Nishizawa ..... 400/279

FOREIGN PATENT DOCUMENTS

B2-28163 6/1990 Japan .
B2-6-66666 8/1994 Japan .

*Primary Examiner*—John S. Hilten
*Attorney, Agent, or Firm*—Oliff & Berridge, PLC

[57] ABSTRACT

A printer control system including a pulse signal output unit for generating a pulse signal having periods including adjacent high and low levels in a number proportional to movement amount of a carriage; a period calculation unit detecting each rising and falling edge of the pulse signal and thereupon calculating a duration of a most recent period directly prior to a detected one of the rising and falling edges; a print period calculation unit uniformly dividing each received duration by a predetermined number corresponding to the print resolution of the printer to determine a print period for each received duration; and print timing determination unit determining a plurality of first print timings based on a first print period calculated by the print period calculation unit dividing duration of a period directly prior to one of a rising and falling edge of each successive pair of rising and falling edges, and determining a plurality of second print timings based on a first print period calculated by the print period calculation unit dividing duration of a period directly prior to another of the rising and falling edge of each successive pair of rising and falling edges.

15 Claims, 9 Drawing Sheets

PRINT CONTROL SYSTEM

BACKGROUND OF THE INVENTION

1. Field of the Invention

The present invention relates to a print control system for a printing device which prints dot patterns by ejecting ink droplets from a print head while moving a carriage mounted with the print head and more particularly to improving print quality by rapidly changing duration of a print period, at which dots are printed, according to fluctuations in moving speed of the carriage.

2. Description of the Related Art

There have been known ink jet printers with a print head formed with a plurality of jet nozzles. The print head is mounted on a carriage reciprocally movable in a print direction while maintained in confrontation with a print sheet. By ejecting ink from nozzles while using a carriage drive motor to drive the carriage in the print direction, an image can be formed out of dot patterns on the print sheet.

An encoder and a photosensor for determining timing of dot printing are provided in the printer. Either a circular encoder plate formed with a plurality of radial slits is attached to the carriage drive motor or a band-shaped encoder plate formed with slits juxtaposed in a line is disposed parallel to the movement direction of the carriage. The photosensor includes a light emitting element and a light receiving element attached to transmit and receive light through the slits. The photosensor emits a pulse signal formed from alternating high and low level signals, which correspond to presence and absence of slits, and having a period equal to the sum of successive high and low level signals. The number of high and low level signals outputted from the photosensor is proportional to the distance moved by the carriage. Also, time duration of one period of the pulse signal indicates the speed of the carriage. By calculating these pulse signals, the print position of the carriage and the movement speed of the carriage can be determined so that timing of the dot printings can be determined.

Recently, the print resolution of ink jet printers has been increased, for example, to 360 dots per inch (DPI) or 720 DPI, in order to improve quality of images is printed by the ink jet printer on paper. There have been known some problems when the print timing for ejecting dots is determined by the timing of rising and falling edges of the pulse signal outputted by the photosensor. For example, when the plate-shaped encoder is incorrectly attached so that slits and slats are shifted out of correct alignment, then the time duration of high and low level signals can vary. Also, duration of one period can vary because of fluctuations in the rotational speed of the carriage drive motor. In addition to these problem, when the print resolution is 360 DPI or 720 DPI, the slits must be formed in the encoder plates at an extremely narrow pitch, which makes their manufacture virtually impossible or prohibitively expensive. Also, paper dust or other debris can partially or totally cover slits, thereby altering the detected period.

Japanese Patent Application (Kokai) HEI-6-66666 describes a pulse interval conversion unit for an ink jet printer with two encoders for detecting each slit in a slit plate attached to the carriage drive motor. Each of the encoders outputs a pulse signal, one signal having an A phase and the other having a B phase, the A phase and the B phase having a phase difference. The ink jet print printer is also provided with a pulse interval calculation circuit, a digital filter, a standard pulse generation circuit, and a pulse interval conversion circuit in a configuration for determining the duration of one period by adding four separate pulse time durations together. The four time durations added together to determine the period are the pulse time duration from the rising edge of the A phase to the rising edge of the B phase, the next pulse time duration from the rising edge of the B phase to the falling edge of the A phase, the next pulse time duration from the falling edge of the A phase to the falling edge of the B phase, and in the next pulse time duration from the falling edge of the B phase to the rising edge of the A phase.

The calculated duration for one period is divided by a predetermined number of four to determine an average pulse time duration. A print timing pulse is generated each time the average pulse time duration elapses. The print timing pulses serve as a reference pulse train.

Additionally, reference pulse number values and delay coefficient values are prestored in correspondence in a change table in accordance with different ratios of change in the pulse interval between adjacent pulses. A reference pulse number value and a delay coefficient value for a selected pulse interval ratio of change are retrieved from the change table. The delay coefficient value is multiplied by speed data to determine a pulse interval. Each time a duration of time corresponding to the calculated pulse interval elapses, a print timing pulse is outputted in association with a reference pulse until a number of reference pulses has been applied. As a result, each print timing can be determined based on rotational speed of the carriage drive motor.

Japanese Patent Application (Kokai) HEI-2-28163 discloses a drive amount detection device which determines, based on two pulse signals having A and B phases respectively, print timing for dot printing by determining duration of one period by adding four pulse time durations.

SUMMARY OF THE INVENTION

The pulse interval conversion unit disclosed in Japanese Patent Application (Kokai) HEI-6-66666 includes many components such as the pulse interval calculation circuit, the digital filter, the reference pulse generating circuit, the pulse interval conversion circuit, and the like. Calculation processes and the circuit configuration for performing these calculation processes are complicated. Also, print timings in each period are determined based on the duration of the previous period. In other words, information by which a period is determined is one period old when applied. For this reason, fluctuations in the speed of the carriage drive motor can not rapidly reflected. This leads to a drop in print quality because of irregular dot intervals.

It is an objective of the present invention to overcome the above-described problems and to provide a print control unit capable of improved printing quality by determining print timing for dot printing using simple calculation processes that rapidly reflect fluctuations in movement speed of the carriage.

In order to achieve the above-described objectives, a print control system according to the present invention is used in a printer capable of printing at a resolution, the printer including a print head for printing dots, a carriage mounting the print head, and a carriage drive mechanism for driving the carriage to move in a direction, and the print control system comprises: pulse signal output means for generating a first pulse signal formed from alternating high and low levels defined by alternating rising and falling edges in a number proportional to movement amount of the carriage, adjacent pairs of high and low levels forming periods; period calculation means detecting each rising and falling edge from the pulse signal output means and, upon detection of each rising and falling edge, calculating a duration of a most recent period directly prior to a detected one of the rising and falling edges; print period calculation means receiving each duration from the period calculation means and uniformly dividing each received duration by a predetermined number corresponding to the print resolution to determine a print period for each received duration; and print timing determination means for detecting each rising and falling edge of the first pulse signal, determining a plurality of first print timings based on a first print period calculated by the print period calculation means dividing duration of a period directly prior to one of a rising and falling edge of each successive pair of rising and falling edges, and determining a plurality of second print timings based on a first print period calculated by the print period calculation means dividing duration of a period directly prior to another of the rising and falling edge of each successive pair of rising and falling edges.

According to another aspect of the invention, the print period calculation means sets the one of the rising and falling edge of each successive pair of rising and falling edges as a reference print timing, sets the plurality of first print timings to follow the reference print timing, sets, upon receipt of the another of the rising and falling edge of each successive pair of rising and falling edges, a one of the plurality of first print timings directly subsequent to the another of the rising and falling edge of each successive pair of rising and falling edges as an auxiliary reference print timing, and sets the plurality of second print timings to follow the auxiliary reference print timing.

According to still another aspect of the present invention, the pulse signal output means further generates a second pulse signal formed from alternating high and low levels defined by alternating rising and falling edges in a number proportional to movement amount of the carriage, the pulse signal output means generating the first pulse signal in a first phase and the second pulse signal in a second phase so that the first phase differs from the second phase by a predetermined phase amount; and the print timing determination means detects rising and falling edges of the second pulse signal; sets each print timing directly after each rising and falling edge of each successive pair of rising and falling edges of the second signal as further auxiliary reference print timings to follow the reference print timing; and sets, after a corresponding further auxiliary reference print timing, a plurality of further second print timings based on a print period calculated by the print period calculation means dividing a period directly prior to a corresponding one of the rising and falling edges of each pair of successive rising and falling edges of the second signal.

A print control method according to the present invention includes the steps of: generating a first pulse signal formed from alternating high and low levels defined by alternating rising and falling edges in a number proportional to movement amount of the carriage, adjacent pairs of high and low levels forming periods; calculating a duration of a most recent period directly prior to each rising and falling edge; uniformly dividing each duration by a predetermined number corresponding to the print resolution to determine a print period for each duration; setting a plurality of first print timings based on a first print period calculated by dividing duration of a period directly prior to one of a rising and falling edge of each successive pair of rising and falling edges; and setting a plurality of second print timings based on a first print period calculated by dividing duration of a period directly prior to another of the rising and falling edge of each successive pair of rising and falling edges.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
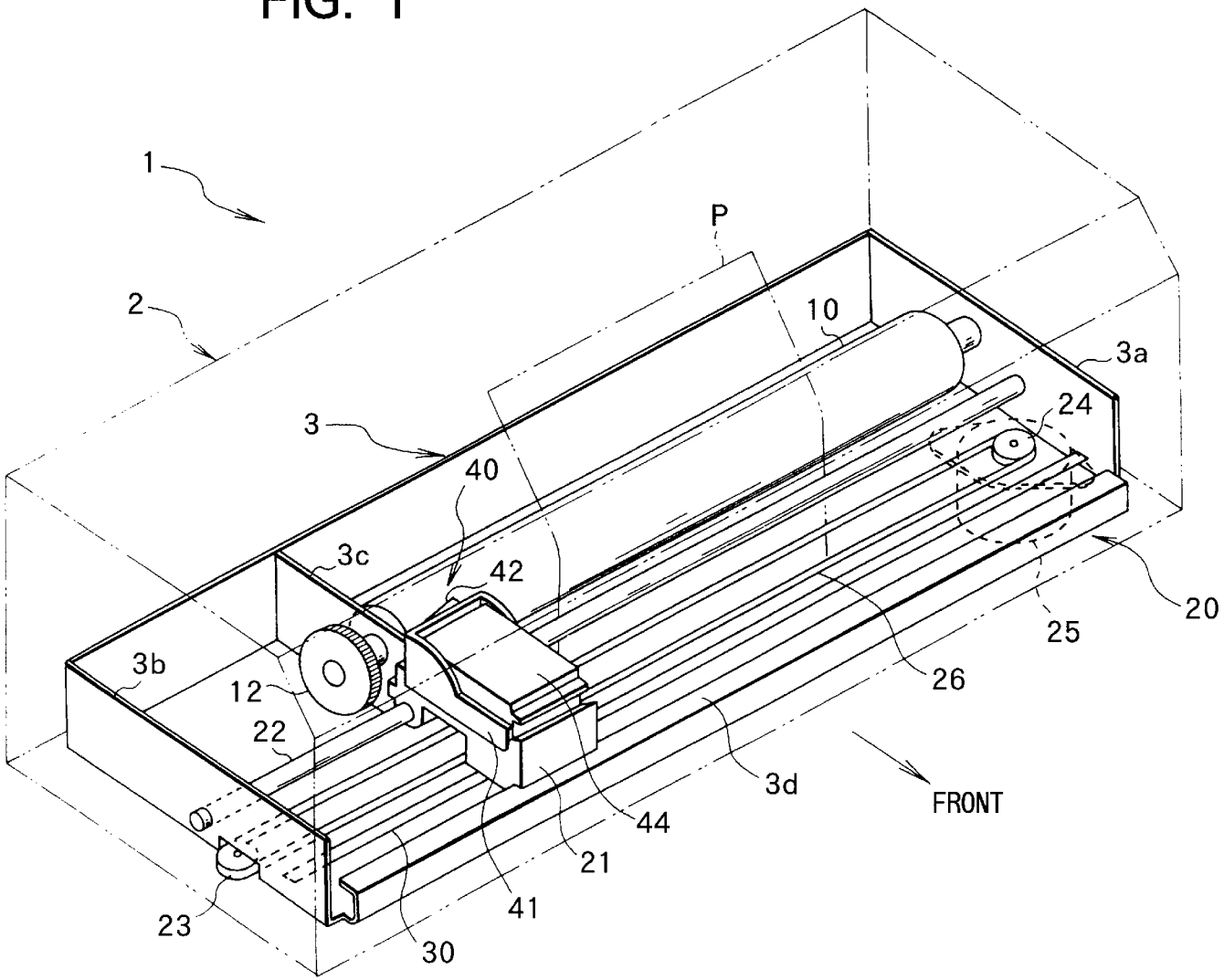
FIG. 1 is perspective view partially in phantom showing a printer to which a print control system of the present invention is applied.

A print control system according to a preferred embodiment of the present invention will be described while referring to the accompanying drawings wherein like parts and components are designated by the same reference numerals to avoid duplicating description. In the following description, unless stated otherwise directional terms, such as left, right, front, rear, up, and down will refer to configuration and orientation of components when the ink jet printer is in an orientation in which it is meant to be used.

Figure 2:
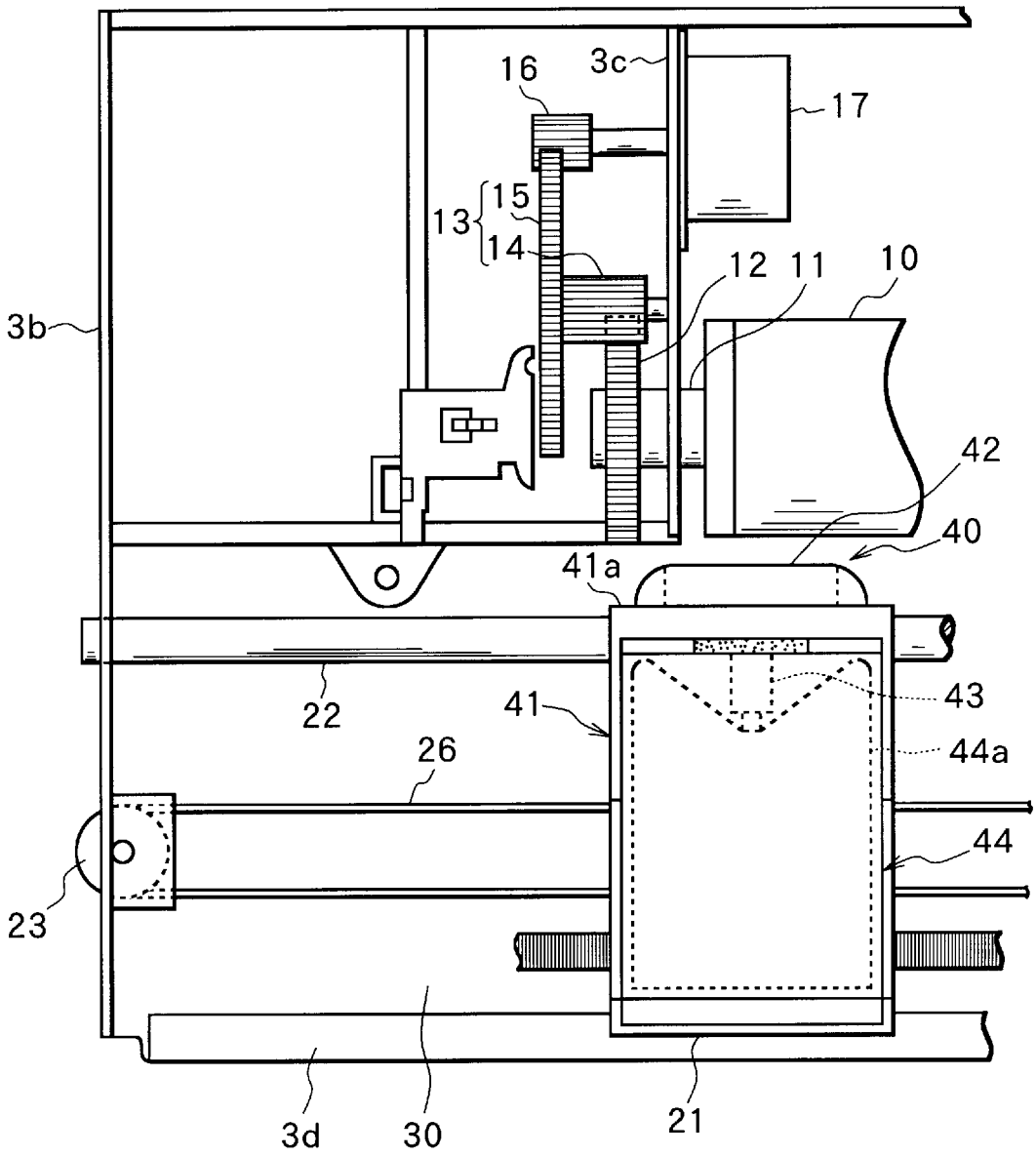
FIG. 2 is a plan view showing a printing mechanism of the printer.

The present embodiment describes the present invention applied to an ink jet printer for recording images by ejecting ink droplets from a print head supplied with ink from a detachably mounted ink cartridge. As shown in FIG. 2, an ink jet printer 1 includes a frame 3 provided within a cover 2; a platen 10; a carriage drive mechanism 20 for driving a carriage 21; and an ink ejection mechanism 30 for ejecting toward a print sheet P ink contained in an ink cartridge 40.

Figure 3:
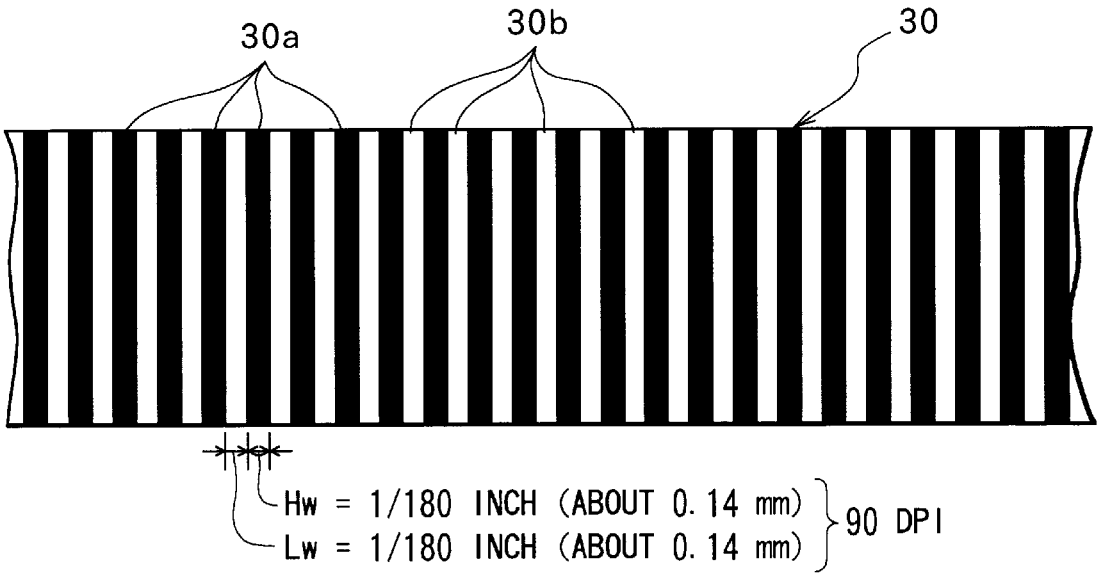
FIG. 3 is magnified plan view showing an encoder member of the printer.

The platen 10 includes a platen shaft 11 extending leftward and rightward as viewed in FIG. 3 and a rubber material surrounding the platen shaft 11. The platen 10 is rotatably supported by the right and left tips of the platen shaft 11 on side walls 3*a*, 3*c* of the frame 3 respectively. A platen gear 12 is fixed to the left tip of the platen shaft 11. A compound gear 13 including a first slave gear 14, meshingly engaged with the platen gear 12, and a second slave gear 15 is rotatably supported on the side wall 3*c*. A drive gear 16 meshingly engaged with the second slave gear 15 is fixed to the shaft of a feed motor 17. With this configuration, when the feed motor 17 is given to rotate in a predetermined direction, the drive gear 16 rotates in the same direction. This rotates the platen gear 10 via the compound gear 13 and the platen gear 12 so that a print sheet P is fed in a predetermined sheet feed direction.

Next, an explanation for the carriage drive mechanism 20 will be provided while referring FIGS. 2 and 3. A carriage 21 is disposed in a horizontal posture in front of the platen 10. A guide rod 22 and a guide rail portion 3*d* are supported on the frame 3 in parallel with the platen 10. The carriage 21 is mounted at its front edge on the guide rod 22 and at its rear edge on the guide rail portion 3*d* so as to be freely reciprocally movable leftward and rightward. The guide rail portion 3*d* is disposed at the front edge portion of the frame 3.

An idle pulley 23 is rotatably supported on the side wall 3*b* at the left-most edge of the movement range of the carriage 21. A drive pulley 24 attached to the drive shaft of a carriage drive motor 25, such as a stepping motor, is provided to the right-most edge of the movement range of the carriage 21. An endless timing belt 26 is suspended between the pulleys 23, 24. The timing belt 26 is attached to the lower edge of the carriage 21. With this configuration, when the carriage drive motor 25 is driven to rotate, the carriage 21 is driven by the pulleys 23, 24 and the timing belt 26 while supported on the guide rod 22 and guide rail portion 3*d* to move reciprocally in a print direction, that is, rightward, and a reverse direction, that is, leftward.

A thin-film band-shaped encoder member 30 is provided below the carriage 21 so as to extend in leftward and rightward directions. As best be seen in FIG. 3, the encoder member 30 is formed with alternating high level portions 30*a* printed black with a predetermined width Hw and low level portions 30*b* transparent with a predetermined width Lw. A photosensor 31 is fixedly attached below the carriage 21 so as to confront the encoder member 30. The photosensor 31 outputs pulse signals formed from alternating high level signals in correspondence with the high level portions 30*a* and low level signals in correspondence with the low level portions 30*b*. The alternating high and low levels are defined by alternating rising and falling edges in a number proportional to movement amount of the carriage 21.

In order to allow printing in two levels of print resolution, that is, 360 DPI and 720 DPI, the high level portions 30*a* and the low level portions 30*b* are provided with widths Hw, Lw respectively of 1/180 inch (approximately 0.14 mm) in the direction which the carriage 21 travels. This width is calculated in the following manner. Because the interval between adjacent dots, or the dot interval, is 1/360 inch when printing in 360 DPI, and 1/720 inch when printing in 720 DPI, the smallest common multiple at which printing is possible in both print resolutions is 90 DPI. The dot interval at 90 DPI is 1/90 inch. Because the dot interval of 1/90 inch corresponds to the distance of one complete period, the widths Hw and Lw are set at half this value, or 1/180 inch for both the high level portion 30*a* and for the low level portion 30*b*.

A duration time T of one period includes one high level duration outputted from the photosensor 31 in correspondence to one of the high level portions 30*a* and one low level duration outputted from the photosensor 31 in correspondence to one of the low level portions 30*b*. By evenly dividing the period duration T by a predetermined number corresponding to the number of dots to be printed per period, a print period t required for printing one dot can be determined. For example, when printing with a print resolution of 720 DPI, the predetermined number is eight, because eight dots are printed per period. When printing at a print resolution of 360 DPI, the predetermined number is four because four dots are printed per period. Even when the encoder member 30 of the photosensor 31 is imprecisely installed so that high and low portions of the resultant signal have different durations, the period duration T will be a fixed value and will correspond to a dot interval of 1/90 inch. This is because the distance between slit and sensor, or the threshold of the sensor, is different for discerning high and low portions.

Next, an ink ejection mechanism 40 for ejecting ink onto a print sheet P will be described while referring to FIGS. 1 and 2. A box-shaped head holder 41 having open upper and front sides is mounted onto the carriage 21. An ink ejection print head 42 and a connection tube 43 are provided to a rear wall portion 41*a* of the head holder 41. A plurality of nozzles are4 formed in the ink ejection print head 42. The connection tube 43 is integrally connected with the print head 42 by passing through the rear wall portion 41*a*.

An ink cartridge 44 housing an ink-filled ink absorbing member 44*a* is detachably mounted on the heat holder 41. The connection tube 43 passes through an ink supply port (not shown in the drawings) formed in the ink cartridge 44 so that its tip contacts the ink absorbing member 44*a*. With this configuration, ink from the ink cartridge 44 is supplied through the connection tube 43 to the print head 42. The ink is ejected from the nozzles of the print head 42 and printed on a recording sheet P.

Figure 4:
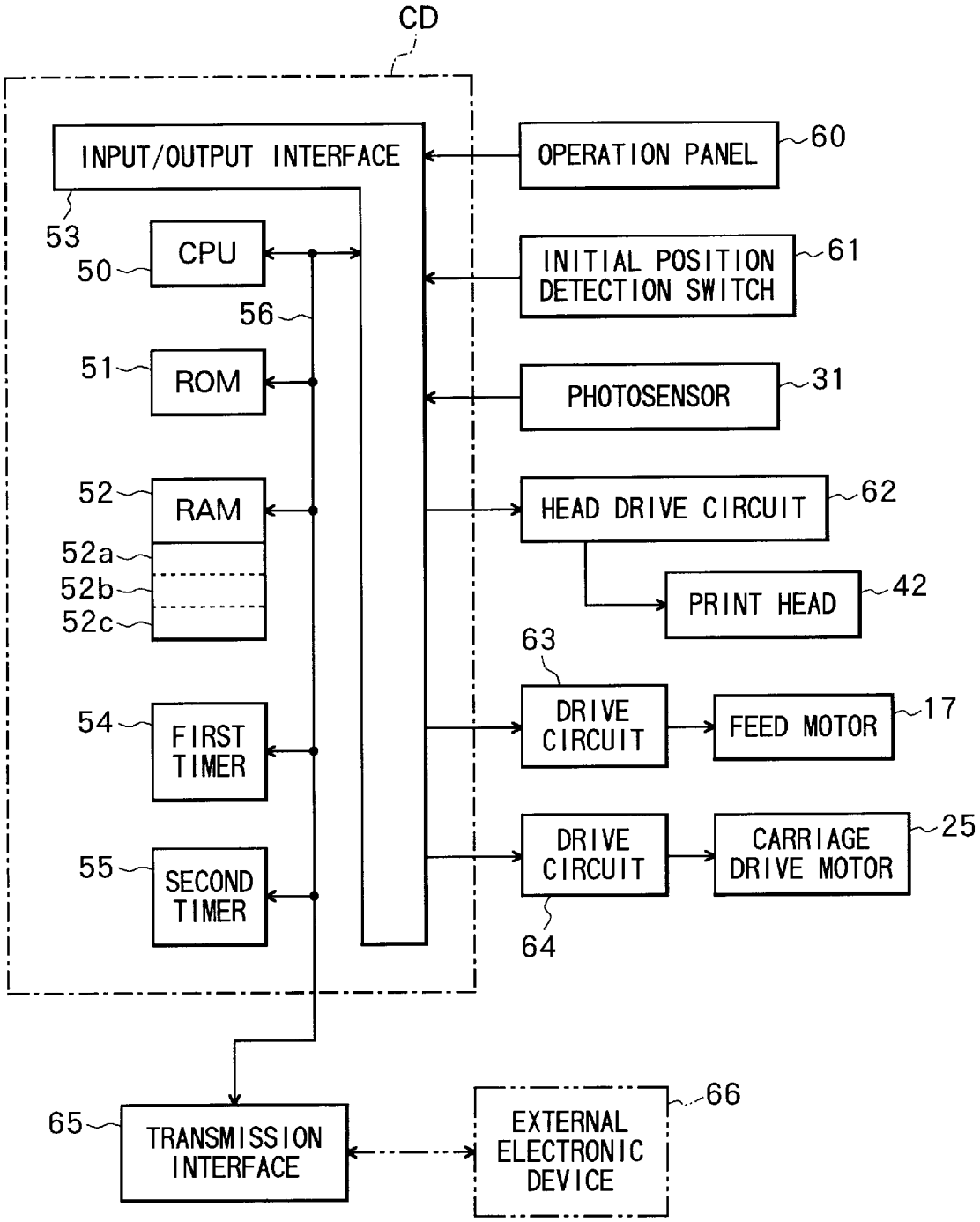
FIG. 4 is a block diagram showing components of a print control system according to a first embodiment of the present invention and their electrical connection to other components of the printer.

Next, an explanation for a control system of the ink jet printer 1 will be described while referring to the block diagram in FIG. 4.

A control device CD has an input/output interface 53 connected with various components of the printer 1 including an operation panel 60 provided with a power key and a variety of switches and display lamps; an initial position detection switch 61 for detecting initial position of the carriage 21; the photosensor 31; a head drive circuit 62 for driving the print head 42; a drive circuit 63 for driving the feed motor 17; and a drive circuit 64 for driving the carriage motor drive 25.

The control unit CD includes a CPU 50; the input/output interface 53 connected via a bus 56 such as a data bus to the CPU 50 and other components of the control unit CD; a ROM 51; a RAM 53; and a first timer 54 and a second timer 55 both formed from hardware timers. Further, the bus 56 is connected to a transmission interface 65 for enabling reception of image data transmitted from an external electronic device 66 such as a host computer. The first timer 54 measures period duration T formed from high and low level durations of the pulse signal outputted by the photosensor 31 and outputs a timer signal accordingly. The second timer 55 measures passage of the print period t for printing one dot.

The ROM 51 stores programs for controlling print operations based on detected image data. The ROM 51 also stores a period duration calculation program wherein a timer signal outputted from the first timer 54 upon elapse of a short time interval is detected by way of an interrupt routine. With each rising edge of the pulse signal outputted by the photosensor 31, a rising edge period duration T formed from the most recent high and low level durations is calculated. Also, with each falling edge of the pulse signal, a falling edge period duration T2 formed from the most recent high and low level durations is calculated.

The RAM 52 includes a period duration memory 52*a* updated with each period duration T1, T2 newly calculated based on the timer signal from the first timer 54; a print period memory 52*b* storing the print period t determined by calculations to be described later; a print dot counter 52*c* storing a number representing the number of dots printed;

and a variety of other memories and buffers needed for printing of images.

Figure 5:
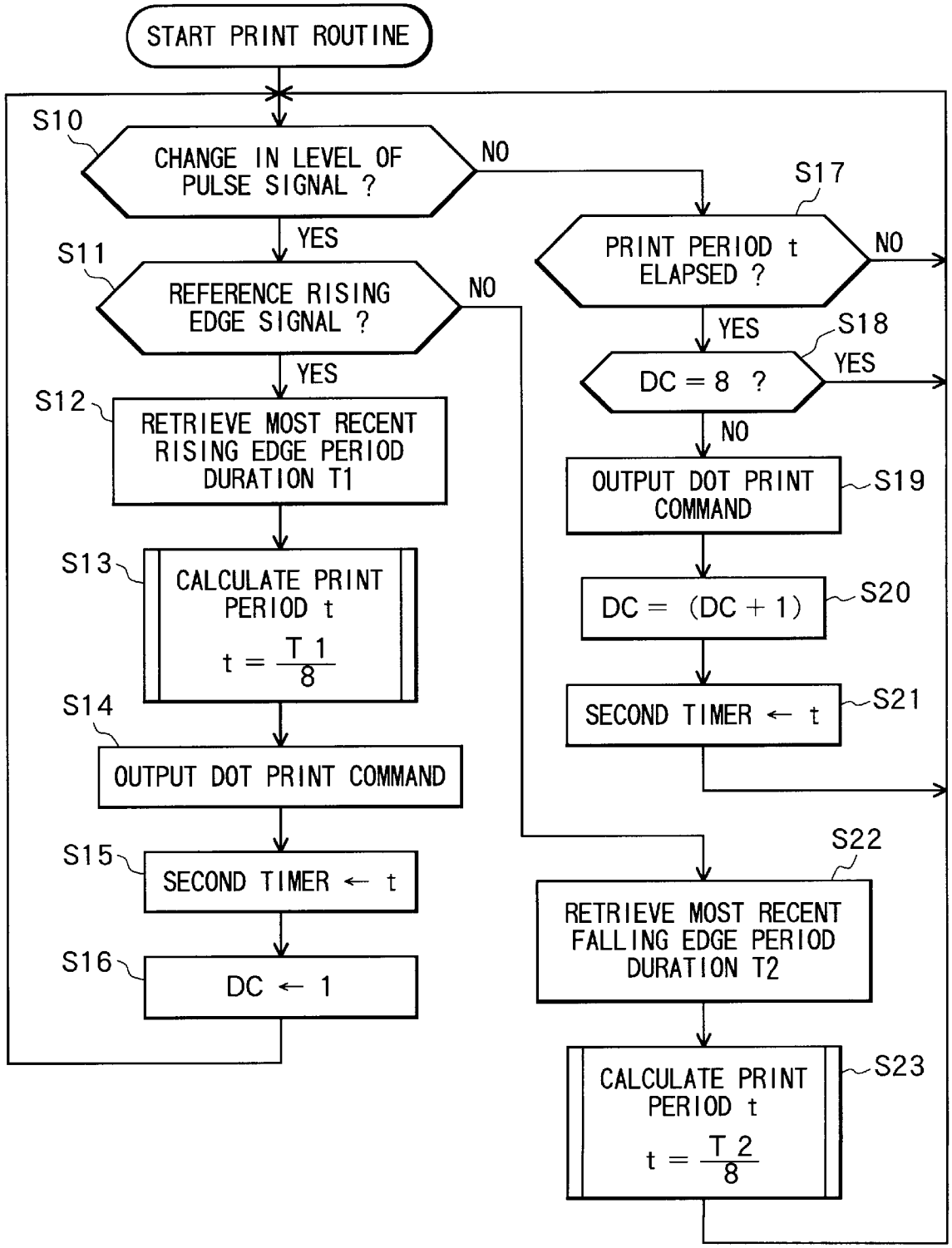
FIG. 5 is a flowchart showing a print routine used in the print control system of the first embodiment.

Next, the print control routine performed in the control unit CD of the ink jet printer 1 will be explained while referring to the flowchart in FIG. 5 and the timing chart in FIG. 6. Individual steps in the print control routine will be referred to in the following text and the flowchart as Si wherein i=10, 11, 12 . . . i. It will be assumed in the following explanation that the printer 1 is set to a resolution of 720 DPI. That is to say, eight dots are printed during each rising edge period duration T1 and falling edge period duration T2. Each print period t for printing one of each eight dots is calculated by uniformly dividing the period durations T1, T2 by a predetermined number of eight, because that corresponds to the resolution of 720 DPI as described previously.

The program is started when image data is detected from an external host computer 66 so that printing is possible. First, whether or not a change in the level of the pulse signal from the photosensor 31 is determined in S10. A change detected in S10 can either be from a low level to a high level or from a high level to a low level. If a change is detected (S10:YES), then whether or not the level change is a reference rising edge signal PU is determined in S11. If so(S11:YES), then the most recent rising edge period duration T1 is retrieved from the period duration memory 52*a* of the RAM 52 in S12. The rising edge period duration T1 is uniformly divided by the predetermined number eight to determine the print period t between adjacent dot print timings. The print period t is then stored in the print period memory 52*b* in S13.

Next, because the reference rising edge signal PU was detected, the reference print timing PT is then determined and a dot print command outputted accordingly in S14. The print head 42 is driven to print a dot as a result of the dot print command. It should be noted that dot print commands can also result in non-printing of a dot depending on the print data from the external electronic device 66. For convenience sake, in the following text it will be assumed that all dot print commands will result in print of a dot. Next, in S15 the print period t stored in the print period memory 52*b* is retrieved from the print period memory 52*b* and set in the second timer 55, whereupon count down operations are started in the second timer 55. Then, the initial value of 1 is set as the dot counter value DC of the print dot counter 52*c* in S16. The routine then returns to S10.

When the print period t elapses, the second timer 55 outputs a time up signal. Whether or not the time up signal is detected is determined in S17. If so (S10:NO, S17:YES), then whether or not the dot counter value DC equals the predetermined number of eight, which represents the number of dots printed during one period duration, is determined in S18. If not, (S18:NO), then an appropriate one of the eight first print timings PT is set and a dot print command is outputted accordingly in S19. Next, the dot counter value DC is incremented by 1 in S20. Then, in S21 the print period t in the print period memory 52 is reset in the second timer 55, whereupon the second timer 55 is restarted. Then the routine again returns to S10.

Figure 6:
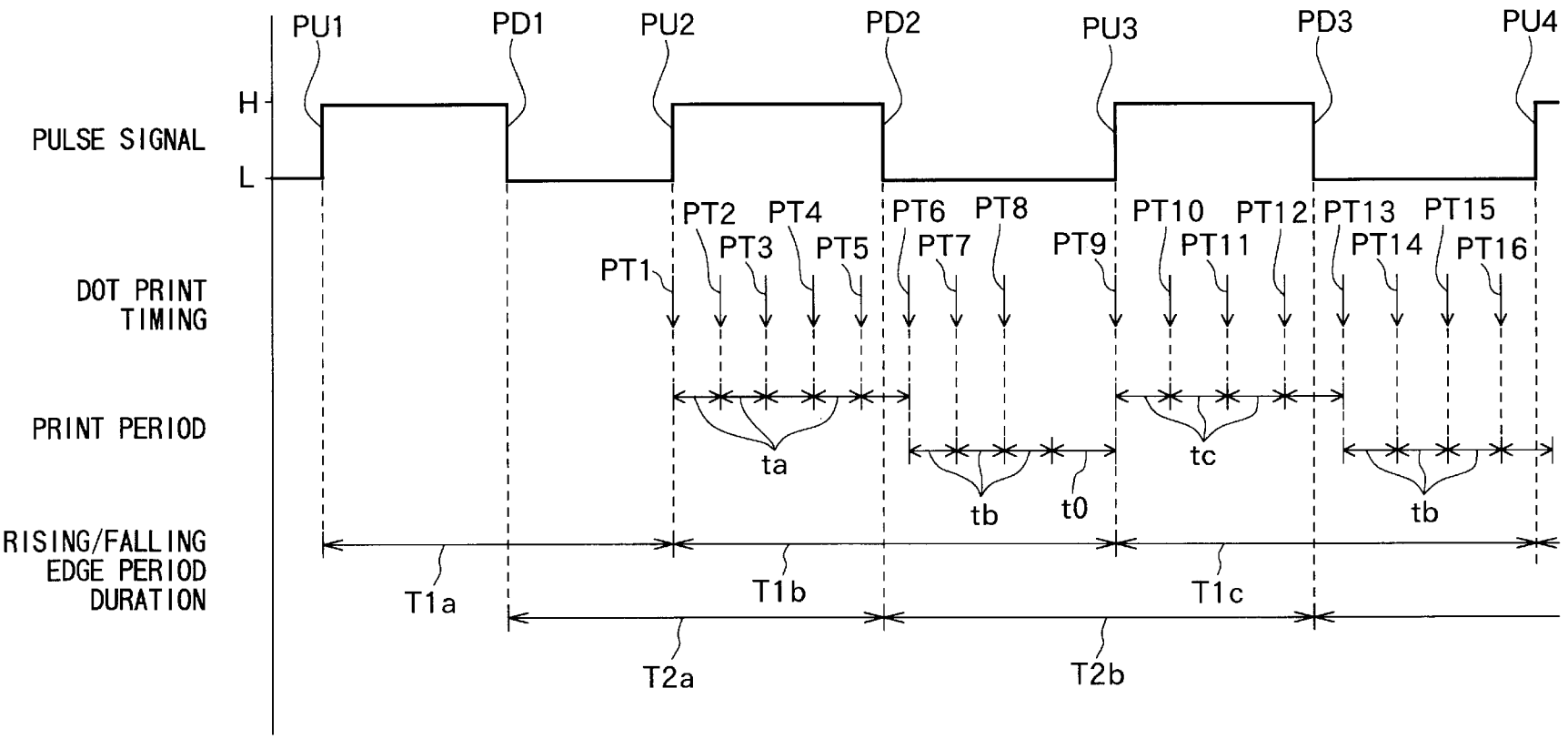
FIG. 6 is a timing chart showing relationship between a pulse signal and print timings determined based on the pulse signal.

In the example shown in FIG. 6, when the reference rising edge signal PU2 is detected in S10, the dot printing period ta between adjacent dots is determined by uniformly dividing the newest rising edge period duration T1*a*, which is the time duration from the reception of the reference rising edge signal PU1 to the reception of the next reference rising edge signal PU2, by the predetermined number eight. Additionally, the reference rising edge signal PU2 is set as a reference print timing PT1 and one dot is printed thereat. Afterward, first print timings PT2, PT3, PT4. PT5 are serially set each time the print period ta elapses. Dots are printed accordingly.

Next, when a detected pulse signal level change is an auxiliary reference falling edge signal PD (S10:YES, S11:NO), then the most recent rising edge period duration T2 is retrieved from the period duration memory 52*a* in S22. Then, in S23 the dot print period t is updated by uniformly dividing the falling edge period duration T2 by the predetermined number eight and the updated value is stored in the print period memory 52*b*. Then the program returns to S10. Afterward, S17 through S21 are repeatedly executed in the same manner as described above. The first print timing after input of the auxiliary falling edge signal PD is set as an auxiliary reference print timing. Each time the print period T elapses, the remaining of the eight dots are printed at corresponding second print timings PT. When the dot counter value DC reaches the predetermined value eight (S10:NO, S17 and S18:YES), then S10 and the following steps are again repeatedly executed until all the detected image data has been printed.

As shown in FIG. 6, when an auxiliary reference falling edge signal PD2 is detected after a dot is printed at the first print timing PT5, then a new print period tb is determined by uniformly dividing the newest falling edge period duration T2*a*, which is from the auxiliary reference falling edge signal PD1 to the next auxiliary reference falling edge signal PD2, by the predetermined number eight. Because the print period ta of the rising edge period duration T1*a* is already set in the second timer 55, a dot is printed at the first print timing PT6 when the print period ta elapses after the first print timing PT5. However, dots will be printed at two second print timings PT7 and PT8 thereafter each time the newly determined print period tb elapses.

At the reference rising edge signal PU3 and each time the print period tc of the most recent rising edge period duration T1*b*, that is, the duration of time from the reference rising edge signal PU2 to the next reference rising signal PU3, elapses after the reference rising edge signal PU3, one dot is printed at each of the first print timings PT10 to PT12 after the first print timing PT9. Also, after an auxiliary reference falling edge signal PD3 is detected and after the next first print timing PT13, each time the print period td of the most recent falling edge period duration T2*b*, which is from the auxiliary reference falling edge signal PD2 to the next auxiliary reference falling edge signal PD3, elapses, then a dot is printed at each of the second print timings PD14 to PD16.

Next, an explanation will be provided for operations of the print control for printing dots while receiving pulse signals from the photosensor 31.

Each time a rising edge or a falling edge of the pulse signal is detected, the period duration T of the most recent period including a high level duration and a low level duration is calculated. Each time a period duration T is calculated, a print period t, which is the interval between printing of adjacent dots, is calculated by uniformly dividing the period duration T by the predetermined number, which is eight when printing in a resolution of 720 DPI. Each time a reference rising edge signal PU of the pulse signal is detected, the reference rising edge signal PU is set as a reference print timing for starting printing of a new dot series, which includes eight dots when 720 DPI or four dots when 360 DPI is started and a plurality of first print timings PT for a first portion of the dot series are determined based on the print period t calculated previously. Printing of the first portion of the dot series is then preformed accordingly. In addition, each time an auxiliary reference falling edge signal PD is detected, the first print timing PT detected most recently after input of the auxiliary signal PD is set as an auxiliary reference print timing for starting printing of the remainder of the dot series and a plurality of the second print timings PT are determined according to the updated print period t determined by calculations described above. Printing of the remainder of the dots is performed accordingly.

In the illusory example of FIG. 6, the rotational speed of the carriage drive motor 25 slowed down so that the rising edge period duration T1*b* from the reference rising edge signal PU2 to the next reference rising edge signal PU3 is longer than the period duration T1*a* from the reference rising edge signal PU1 to the next reference rising edge signal PU2. As a result, then waiting time to is generated from when a last dot of the first dot series is printed at the last of the second print timings PT8 until when a firstdot of a second dot series is printed at the first print timing PT9. However, because the print period tb is determined based on the falling edge period duration T2*a* from the auxiliary reference falling edge signal PD1 to the next auxiliary reference falling edge signal PD2, the waiting time t0 can be reduced to a minimum.

On the other hand, the rotational speed of the carriage drive motor 25 then speeded up so that the rising edge period time T1*c* from the reference rising edge signal PU3 to the next rising edge signal PU4 is shorter than the rising edge period duration T1*b* from the reference rising edge signal to the next reference rising edge signal PU3. As a result, the last print period t between the last print timing PT16 and the first print timing of the next dot series is too short. However, because the print period td is determined based on the falling edge period duration T2*b,* the insufficient portion of the last print period t can be reduced to a minimum.

In this way, the period duration T is successively updated at both the rising edge and the falling edge of the pulse signal. Each time the period duration T is updated, the print period t for determining timing of printing dots is newly determined by dividing the updated period duration T by the predetermined number appropriate for the selected resolution. A plurality of first print timings PT after reception of the reference rising edge signal PU and a plurality of second print timings PT after reception of an auxiliary reference falling edge signal PD, which is after the reference rising edge signal PU, are both determined. Therefore, complicated calculation circuits and complicated calculation processes are unnecessary. Print timing for printing dots can be determined rapidly while reflecting fluctuations in movement speed of the carriage 21 on which the print head 42 is mounted. Print quality can be improved as a result.

Figure 7:
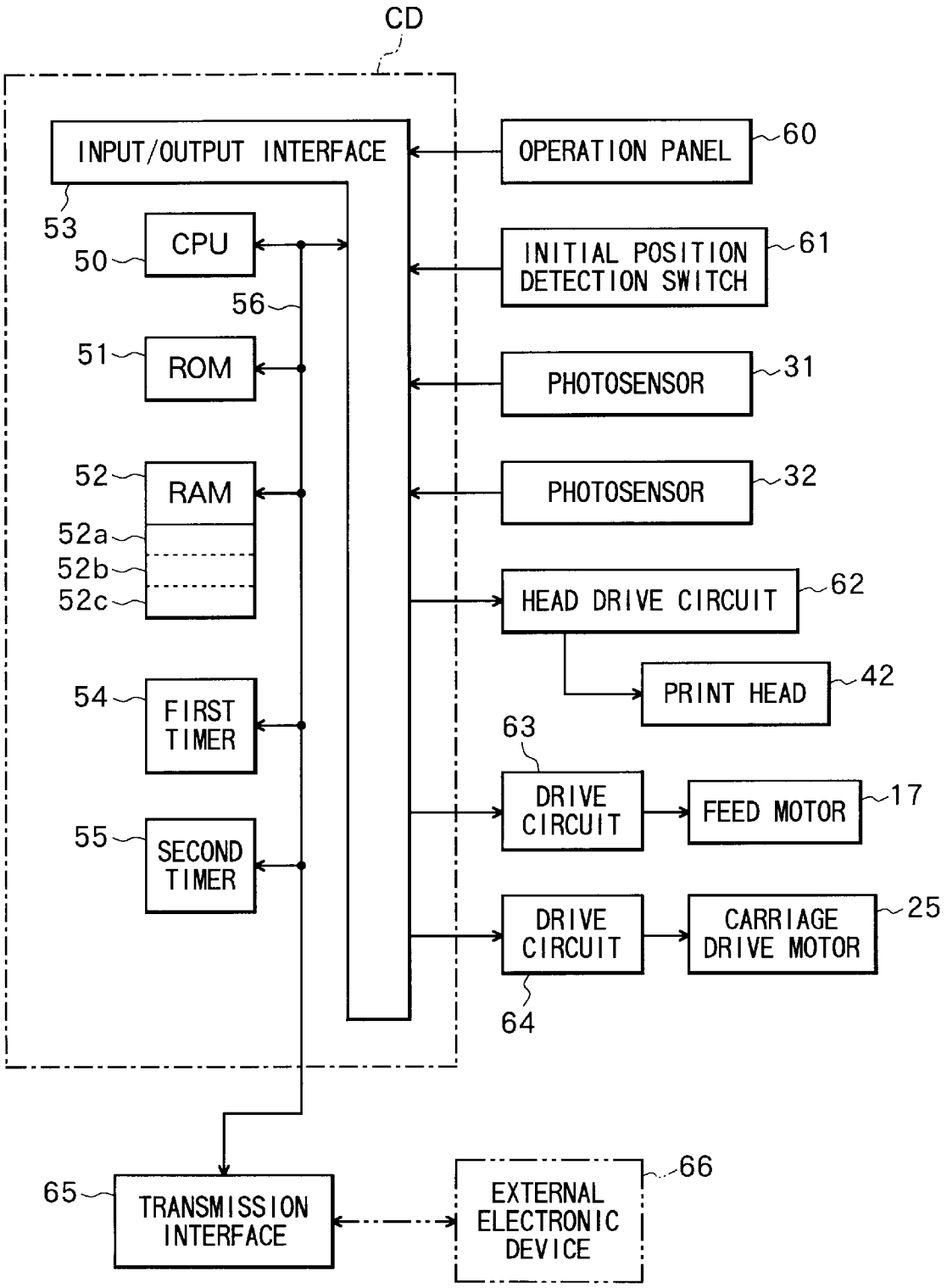
FIG. 7 is a block diagram showing components of a print control system according to a second embodiment of the present invention and their electrical connection to other components of the printer.
Figure 9:
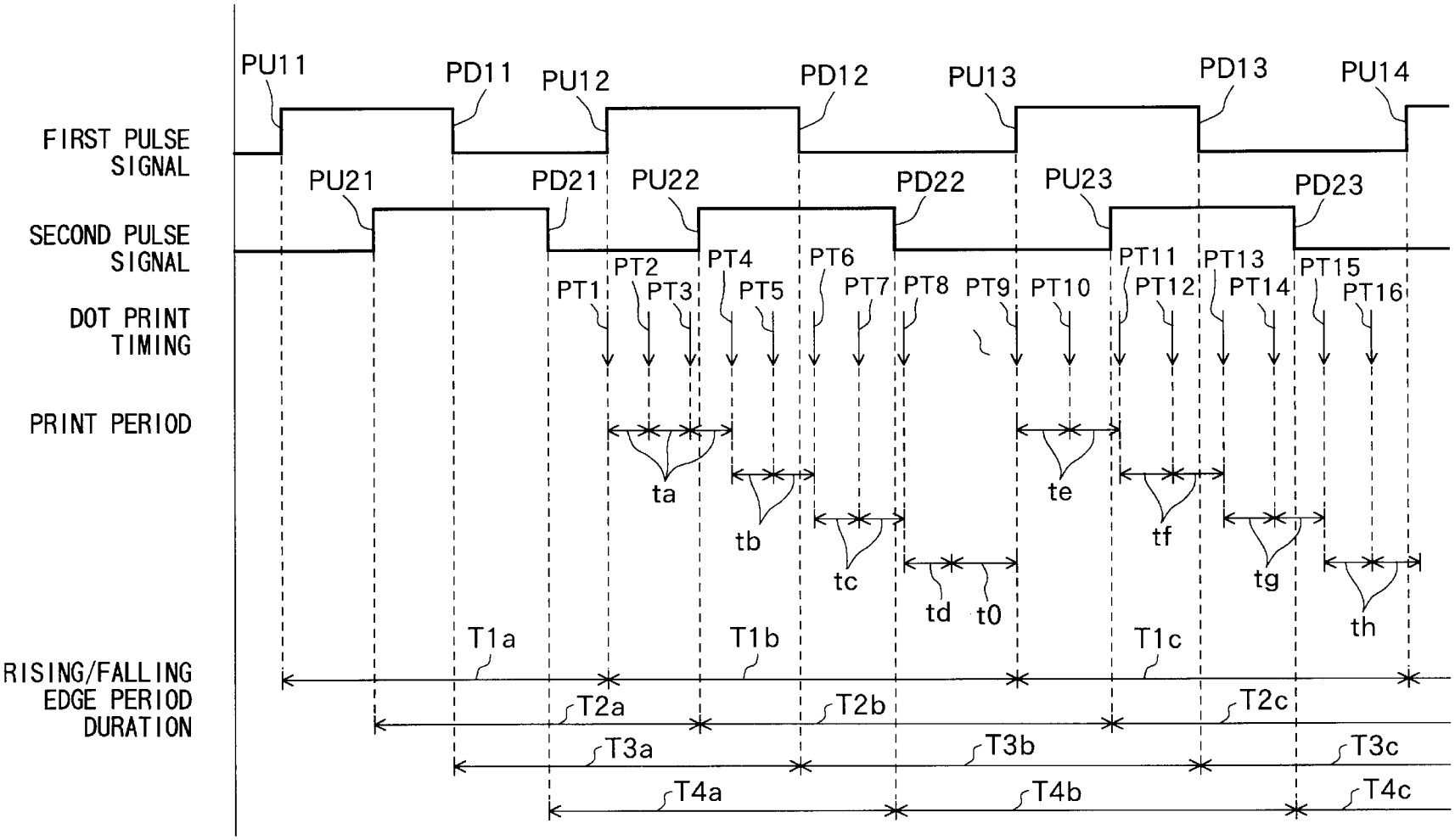
FIG. 9 is a timing chart showing relationship between two pulse signals and print timings determined based on the two pulse signals.

Next, a second embodiment of the present invention will be described. As shown in FIG. 7, in the second embodiment a photosensor 32 is added to the configuration described in the first embodiment with reference to FIG. 4. The photosensor 32 is added to the carriage 31 adjacent to the photosensor 31. As shown in FIG. 9, the photosensor 31 outputs a first pulse signal and the photosensor 32 outputs a second pulse signal in accordance with movement of the carriage 21. However, the second pulse signal has a phase which is delayed from the phase of the first pulse signal by a predetermined phase amount. Printing with dots is performed based on the first pulse signal and a second pulse signal outputted from the photosensors 31, 32 respectively.

Figure 8:
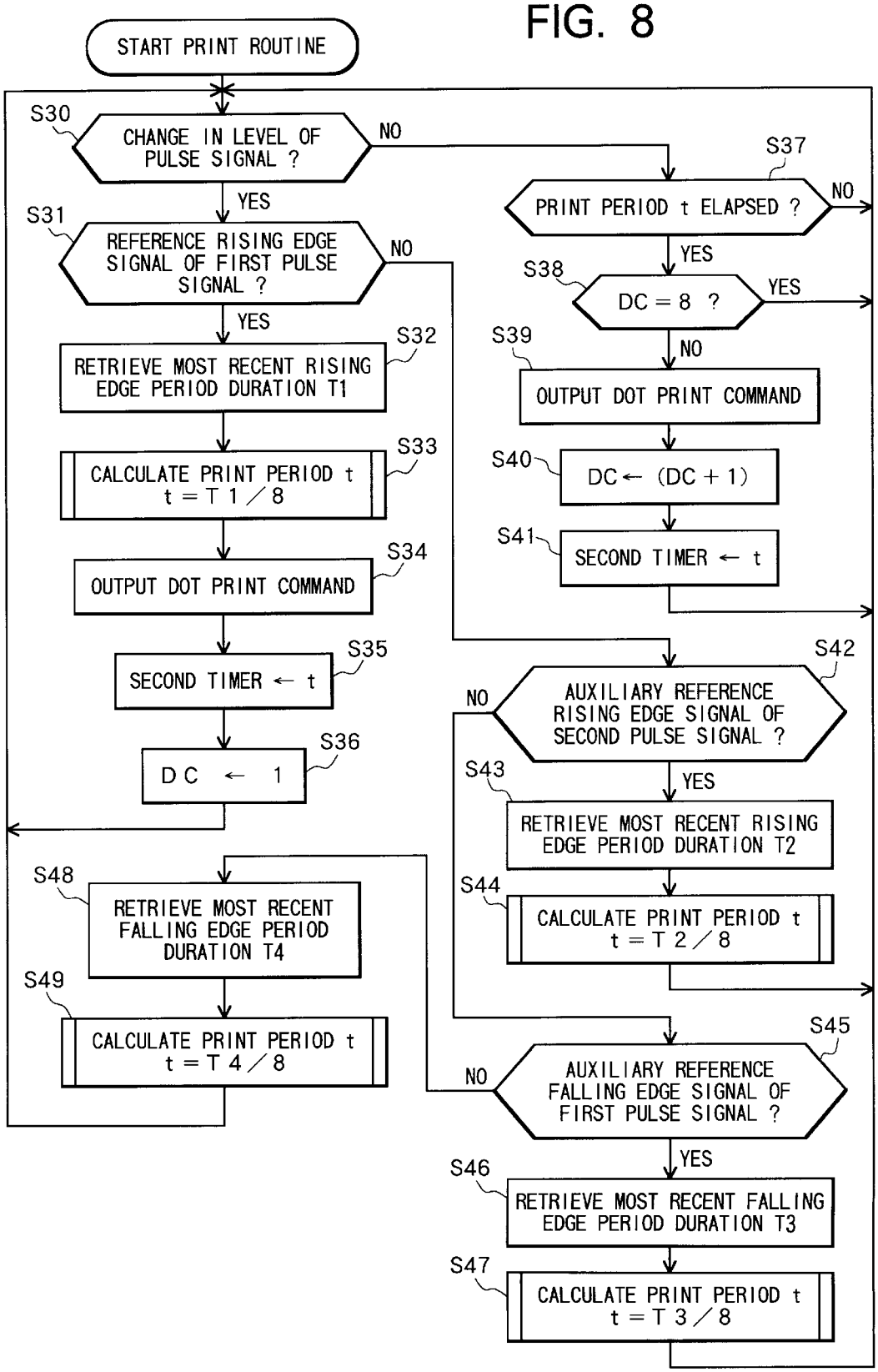
FIG. 8 is a flowchart showing a print routine used in the print control system of the second embodiment.

An explanation of the print control routine stored in the ROM 51 of the control unit CD according to the second embodiment will be provided while referring to FIG. 8. When the first and second pulse signals is detected (S30:YES) and the detected signal is a reference rising edge signal PU of the first pulse signal (S31:YES), then the most recent rising edge period duration T1 of the first pulse signal is retrieved from the period duration memory 52*a* of the RAM 52 in S32. Then, the print periods t for the rising edge period duration T1 is calculated in S33 by dividing the most recent rising edge period duration T1 by the predetermined number. Then S34 through S36 are performed in the same manner as S14 through S16 and dots are printed at reference print timings PT based on the calculated print period t. Then the program returns to S30.

Further, when neither of the first and second pulse signals is detected (S30:NO), then S37 through S41 are performed in the same manner as S17 through S21. A plurality of print timings PT are determined based on calculated print periods t and dots are printed accordingly.

Further, when the auxiliary reference rising edge signal PU of the second pulse signal is detected (S30:YES, S31:NO, S42:YES), then the most recent rising edge period duration T2 of the second pulse signal is retrieved from the period duration memory 52*a* in S43. The print period t based on the rising edge period duration T2 is determined in S44. Then, the program returns to S30.

When the auxiliary reference falling edge signal PD of the first pulse signal is detected (S30:YES, S31 and S42:NO, S45:YES), then the most recent falling edge period duration T3 of the first pulse signal is retrieved from the period duration memory 52*a* in S46. A print period t of the retrieved falling edge period duration T3 is determined in S47 and the program returns to S30.

On the other hand, when the auxiliary reference falling edge signal PD of the second pulse signal is detected (S30:YES, S31, S42, and S45:NO), then the most recent falling edge period duration T4 of the second pulse signal is retrieved from the period duration memory 52*a* in S48. The print period t for the falling edge period duration T4 is determined in S49 and the routine returns to S30.

In the illusory example shown in FIG. 9, when the reference rising edge signal PU12 of the first pulse signal is detected, then the print period ta is determined by uniformly dividing the most recent rising edge period duration T1*a* by the predetermined number eight. After a dot is printed at a reference print timing PT1, which coincides with the reference rising edge signal PU12, then each time the print period ta elapses, print timings PT2 and PT3 are successively determined and dots are printed at these timings. Next, after an auxiliary reference rising edge signal PU22 of the second pulse signal is detected, then a new print period tb is determined based on the most recent rising edge period duration T2*a*. After a dot is printed at the print timing PT4, then a dot is printed at print timing PT5 after the print period tb elapses. When an auxiliary reference falling edge signal PD12 of the first pulse signal is detected, then a new print period tc is determined based on the most recent falling edge period duration T3*a*.

After auxiliary reference falling edge signal PD12, a dot is printed at print timing PT6, which is based on the prior print period tb. The next dot is printed at print timing PT7 after the print period tc elapses. Further, after an auxiliary reference falling edge signal PD22 of the second pulse signal is detected, then the final dot of the first series of eight dots is printed at print timing PT8.

Afterward, in the same manner, when a reference rising edge signal PU13 of the first pulse signal is detected and a dot is printed at print timing PT9 in association with this, then print timings PT10, PT11 are determined based on a print period te of the most recent rising edge period duration T1*b*, print timings PT12, PT13 are determined based on a print period tf of the most recent rising edge period duration T2*b*, print timings PT14, PT15 are determined based on a print period tg of the most recent rising edge period duration T3*b*, and a print timing PT16 is determined based on a print period th of the most recent rising edge period duration T4*b*.

Next, operations for print control for printing dots while receiving the first and the second pulse signals from the photosensors 31, 32 respectively will be explained.

The two photosensors 31, 32 fixed to the carriage 21 output a first pulse signal and a second pulse signal respectively in a number proportional to the movement amount of the carriage 21. It should be noted that the second pulse signal is outputted at a phase that is delayed with respect to a phase of the first pulse signal by a predetermined phase amount. With each rising edge and falling edge of the first and the second pulse signals, a period duration T formed from a high level duration and a low level duration of the most recent period of the corresponding pulse signals is calculated. Further, each time elapse of a period duration T is detected, the print period t for printing dots is calculated by uniformly dividing the period duration T by the predetermined number eight, which corresponds to a print resolution of 720 DPI.

Each time elapse of the reference rising edge signal PU1 of the first pulse signal is detected, the reference rising edge signal PU1 is set as a reference print timing when the first of a series of eight dots is printed. A plurality of print timings PT separated by a print period t determined previously are determined. A new plurality of print timings PT based on corresponding newly calculated print periods t are determined upon detection of each auxiliary reference rising edge signal PU2 of the second pulse signal, of each auxiliary reference falling edge signal PD1 of the first pulse signal, and of each auxiliary reference falling edge signal PD2 of the second pulse signal successively detected after the reference rising edge signal PU1. The first print timing inputted after the subject auxiliary reference signal is set as an auxiliary reference print timing for starting time measure of newly calculated print periods t.

In the illusory example of FIG. 9, when rotational speed of the carriage drive motor 25 slowed down so that the rising edge period duration T1*b* from the reference rising edge signal PU12 to the next reference rising edge signal PU13 is longer than the rising edge period duration T1*a* from the reference rising edge signal PU11 to the next reference rising edge signal PU12. As a result, a waiting time t0 is generated from when a dot is printed at the last of eight second print timings PT8 to when a dot is printed at the next series of eight first print timings PT9. However, because the period duration T upon which the print period t is calculated is successively updated to period durations T2*a*, T3*a*, and T4*a*, the waiting time t0 can be reduced to minimum.

Contrarily, the rotational speed of the carriage drive motor 25 speeded up so that the rising edge period duration T1*c* from the reference rising edge signal PU13 to the next reference rising edge signal PU14 is shorter than the rising edge period duration T1*b* from the reference rising edge signal PU12 to the next reference rising edge signal PU13. As a result, an insufficient amount of the print period t from the last of eight dots printed at print timing PT16 to the next series of eight first print timings can be reduced to a minimum.

In this way, the period duration T formed from a high level duration and a low level duration is successively updated at each rising and falling edge of the first and the second pulse signals. Each time the period duration T is updated, a new print period t for printing dots is determined by dividing the updated period duration T. In this way, print timing can be corrected. Complicated calculation circuits and processes are unnecessary. Print timing for printing dots can be calculated using simple calculations and quickly while reflecting fluctuations in movement speed of the carriage 21 to which the print head 42 is mounted. Print quality can be improved.

The high and low level portions formed in the encoder member all have the same predetermined width in the direction in which the carriage moves. Furthermore, the predetermined width is a multiple of the interval between adjacent dots printed at all print resolutions of the printer. Therefore, even when the printer is set to a high resolution so that only a short distance separates dots, print timings can be set based on the same wide high and low level portions of the pulse signal. The encoder member can be easily and inexpensively manufactured because the high and low lever members are wide.

While the invention has been described in detail with reference to specific embodiments thereof, it would be apparent to those skilled in the art that various changes and modifications may be made therein without departing from the spirit of the invention, the scope of which is defined by the attached claims.

For example, print resolutions other than those described in the embodiments can be used. Further, in place of the plate-shaped encoder member 30, a circular disk plate drawn with a plurality of radial lines can be fixed to the carriage drive motor 25 and the photosensor can be designed to read the lines of the disk plate. Additionally, the falling edge signal of the pulse signal can be set as a reference signal and the rising edge signal of the pulse signal can be set as an auxiliary reference signal. Also, the present invention can be applied to a print control device for controlling an ink ejection mechanism of an ink jet printer capable of printing full color.

What is claimed is:

1. A print control system used in a printer capable of printing at a resolution, the printer including a print head for printing dots, a carriage mounting the print head, and a carriage drive mechanism for driving the carriage to move in a direction, the print control system comprising:

pulse signal output means for generating a first pulse signal formed from alternating high and low levels defined by alternating rising and falling edges in a number proportional to movement amount of the carriage, adjacent pairs of high and low levels forming periods;

period calculation means detecting each rising and falling edge from the pulse signal output means and, upon detection of each rising and falling edge, calculating a duration of a most recent period directly prior to a detected one of the rising and falling edges;

print period calculation means receiving each duration from the period calculation means and uniformly dividing each received duration by a predetermined number corresponding to the print resolution to determine a print period for each received duration; and print timing determination means for detecting each rising and falling edge of the first pulse signal, determining a plurality of first print timings based on a first print period calculated by the print period calculation means dividing duration of a period directly prior to one of a rising and falling edge of each successive pair of rising and falling edges, and determining a plurality of second print timings based on a first print period calculated by the print period calculation means dividing duration of a period directly prior to another of the rising and falling edge of each successive pair of rising and falling edges.

2. A print control system as claimed in claim 1, wherein the print period calculation means sets the one of the rising and falling edge of each successive pair of rising and falling edges as a reference print timing, sets the plurality of first print timings to follow the reference print timing, sets, upon receipt of the another of the rising and falling edge of each successive pair of rising and falling edges, a one of the plurality of first print timings directly subsequent to the another of the rising and falling edge of each successive pair of rising and falling edges as an auxiliary reference print timing, and sets the plurality of second print timings to follow the auxiliary reference print timing.

3. A print control system as claimed in claim 2 wherein:

the pulse signal output means further generates a second pulse signal formed from alternating high and low levels defined by alternating rising and falling edges in a number proportional to movement amount of the carriage, the pulse signal output means generating the first pulse signal in a first phase and the second pulse signal in a second phase so that the first phase differs from the second phase by a predetermined phase amount; and the print timing determination means detects rising and falling edges of the second pulse signal; sets each print timing directly after each rising and falling edge of each successive pair of rising and falling edges of the second signal as further auxiliary reference print timings to follow the reference print timing; and sets, after a corresponding further auxiliary reference print timing, a plurality of further second print timings based on a print period calculated by the print period calculation means dividing a period directly prior to a corresponding one of the rising and falling edges of each pair of successive rising and falling edges of the second signal.

4. A print control system as claimed in claim 3, wherein the pulse signal output means includes:

a band shaped encoder portion extending parallel with the direction in which the carriage moves and including alternating high level portions and low level portions; and a photosensor fixedly provided to the carriage so as to confront the encoder and for optically detecting the high level portions and the low level portions of the encoder.

5. A print control system as claimed in claim 4, wherein the high level portions and low level portions of the encoder portion are formed with a width in the direction in which the carriage moves, the width being a multiple of a dot interval produced when the printer prints at the resolution.

6. A print control system as claimed in claim 5, wherein the printer is capable of printing at a plurality of resolutions and the width is a common multiple of each dot interval produced when the printer prints at each resolution.

7. A print control system as claimed in claim 2, wherein the pulse signal output means includes:

a band shaped encoder portion extending parallel with the direction in which the carriage moves and including alternating high level portions and low level portions; and a photosensor fixedly provided to the carriage so as to confront the encoder and for optically detecting the high level portions and the low level portions of the encoder.

8. A print control system as claimed in claim 7, wherein the high level portions and low level portions of the encoder portion are formed with a width in the direction in which the carriage moves, the width being a multiple of a dot interval produced when the printer prints at the resolution.

9. A print control system as claimed in claim 1 wherein:

the pulse signal output means further generates a second pulse signal formed from alternating high and low levels defined by alternating rising and falling edges in a number proportional to movement amount of the carriage, the pulse signal output means generating the first pulse signal in a first phase and the second pulse signal in a second phase so that the first phase differs from the second phase by a predetermined phase amount; and the print timing determination means detects rising and falling edges of the second pulse signal; sets the one of the rising and falling edge of each successive pair of rising and falling edges of the first pulse signal as a reference print timing for the plurality of first print timings; sets each print timing directly after each rising and falling edge of each successive pair of rising and falling edges of the second signal and the another of the rising and falling edge of each successive pair of rising and falling edges of the first pulse signal as auxiliary reference print timings for the plurality of second print timings to follow the reference print timing; and sets, after corresponding auxiliary reference print timings, corresponding ones of the plurality of second print timings based on print periods calculated by the print period calculation means dividing a period directly prior to a corresponding one of the another one of each pair of successive rising and falling edges of the first signal and the rising and falling edges of each pair of successive rising and falling edges of the second signal.

10. A print control system as claimed in claim 1, wherein the pulse signal output means includes:

a band shaped encoder portion extending parallel with the direction in which the carriage moves and including alternating high level portions and low level portions; and a photosensor fixedly provided to the carriage so as to confront the encoder and for optically detecting the high level portions and the low level portions of the encoder.

11. A print control system as claimed in claim 10, wherein the high level portions and low level portions of the encoder portion are formed with a width in the direction in which the carriage moves, the width being a multiple of a dot interval produced when the printer prints at the resolution.

12. A print control system as claimed in claim 11, wherein the printer is capable of printing at a plurality of resolutions and the width is a common multiple of each dot interval produced when the printer prints at each resolution.

13. A print control method used in a printer capable of printing at a resolution, the printer including a print head for printing dots, a carriage mounting the print head, and a carriage drive mechanism for driving the carriage to move in a direction, the print control method comprising the steps of:

generating a first pulse signal formed from alternating high and low levels defined by alternating rising and falling edges in a number proportional to movement amount of the carriage, adjacent pairs of high and low levels forming periods;

calculating a duration of a most recent period directly prior to each rising and falling edge;

uniformly dividing each duration by a predetermined number corresponding to the print resolution to determine a print period for each duration;

setting a plurality of first print timings based on a first print period calculated by dividing duration of a period directly prior to one of a rising and falling edge of each successive pair of rising and falling edges; and setting a plurality of second print timings based on a first print period calculated by dividing duration of a period directly prior to another of the rising and falling edge of each successive pair of rising and falling edges.

14. A print control method as claimed in claim 13, further comprising the steps of:

setting, prior to the step of setting the plurality of first print timings, the one of the rising and falling edge of each successive pair of rising and falling edges as a reference print timing;

setting, during to the step of setting the plurality of first print timings, the plurality of first print timings to follow the reference print timing;

setting, prior to the step of setting the plurality of second print timings, a one of the plurality of first print timings directly subsequent to the another of the rising and falling edge of each successive pair of rising and falling edges as an auxiliary reference print timing; and setting, during to the step of setting the plurality of second print timings, the plurality of second print timings to follow the auxiliary reference print timing.

15. A print control method as claimed in claim 13, further comprising the steps of:

generating, simultaneously with the step of generating a first pulse signal, a second pulse signal which is formed from alternating high and low levels defined by alternating rising and falling edges in a number proportional to movement amount of the carriage and which has a phase delayed from a phase of the first pulse signal by a predetermined phase amount;

setting, prior to the step of setting the plurality of first print timings, the one of the rising and falling edge of each successive pair of rising and falling edges of the first pulse signal as a reference print timing for the plurality of first print timings;

setting, prior to the step of setting the plurality of second print timings, each print timing directly after each rising and falling edge of each successive pair of rising and falling edges of the second signal and the another of the rising and falling edge of each successive pair of rising and falling edges of the first pulse signal as auxiliary reference print timings for the plurality of second print timings to follow the reference print timing; and during the step of setting the plurality of second print timings, setting, after corresponding auxiliary reference print timings, corresponding ones of the plurality of second print timings based on print periods calculated by the print period calculation means dividing a period directly prior to a corresponding one of the another one of each pair of successive rising and falling edges of the first signal and the rising and falling edges of each pair of successive rising and falling edges of the second signal.

* * * * *